US012140026B2

(12) United States Patent
Rodrigues et al.

(10) Patent No.: US 12,140,026 B2
(45) Date of Patent: Nov. 12, 2024

(54) METHOD OF DRILLING AN INVESTIGATION WELL BY USE OF AUXILIARY TABLE OF A DUAL-ACTIVITY RIG SIMULTANEOUSLY WITH ANOTHER ACTIVITY ON MAIN TABLE

(71) Applicant: PETRÓLEO BRASILEIRO S.A.—PETROBRAS, Rio de Janeiro (BR)

(72) Inventors: Bruno Fidalgo Telles Rodrigues, Rio de Janeiro (BR); Flavia De Oliveira Lima Falcao, Rio de Janeiro (BR); Flank Melo De Lima, Macaé (BR); Joao Paulo Teixeira Da Fonseca, Rio de Janeiro (BR); Guilherme De Almeida Fernandes, Rio de Janeiro (BR); Emanuel Apoema Sortica, Rio de Janeiro (BR); Manuel Parcero Oliveira, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 18/511,244

(22) Filed: Nov. 16, 2023

(65) Prior Publication Data

US 2024/0167340 A1 May 23, 2024

(51) Int. Cl.
*E21B 7/12* (2006.01)
*E21B 21/00* (2006.01)
(Continued)

(52) U.S. Cl.
CPC ..... *E21B 7/12* (2013.01); *E21B 21/001* (2013.01); *E21B 33/14* (2013.01);
(Continued)

(58) Field of Classification Search
CPC ..... E21B 7/12; E21B 21/001; E21B 33/14; E21B 41/0007; E21B 44/00; E21B 47/06
See application file for complete search history.

(56) References Cited

U.S. PATENT DOCUMENTS 8,925,647 B2 * 1/2015 Humphreys ..... E21B 15/02 166/358
9,458,680 B2 * 10/2016 Kannegaard ..... E21B 19/155
(Continued)

*Primary Examiner* — Aaron L Lembo
(74) *Attorney, Agent, or Firm* — Womble Bond Dickinson (US) LLP

(57) ABSTRACT

The present disclosure relates to a method of drilling an investigation well by use of an auxiliary table simultaneously with the operation of a main table of a dual-activity rig, which comprises assembling and lowering the drilling BHA (Bottom-Hole Assembly) with LWD (Logging While Drilling) tools and other components, starting drilling the investigation well with control of parameters, carrying out monitoring with ROV (Remoted Operated Vehicle) on the seabed for as long as possible, working on drilling parameters to optimize the drilling, within a defined rate for data acquisition, controlling flow rate in friable formations, moving viscous plugs to clean the investigation well, carrying out the pre-tests when part of the acquisition scope, promoting circulation of seawater to clean the investigation well, and filling the investigation well with heavy fluid.

12 Claims, 4 Drawing Sheets

(51) Int. Cl.

| | |
|---|---|
| ***E21B 33/14*** | (2006.01) |
| ***E21B 41/00*** | (2006.01) |
| ***E21B 44/00*** | (2006.01) |
| ***E21B 47/06*** | (2012.01) |

(52) U.S. Cl.
CPC ..... *E21B 41/0007* (2013.01); *E21B 44/00* (2013.01); *E21B 47/06* (2013.01)

(56) References Cited

U.S. PATENT DOCUMENTS

| | | | | |
|---|---|---|---|---|
| 10,227,824 | B2 * | 3/2019 | Kannegaard | E21B 11/02 |
| 10,253,572 | B2 * | 4/2019 | Braniff | E21B 19/14 |
| 10,315,733 | B2 * | 6/2019 | Zijderveld | E21B 19/002 |
| 10,570,672 | B2 * | 2/2020 | Kannegaard | E21B 19/143 |
| 2011/0247827 | A1 * | 10/2011 | Humphreys | E21B 7/12 166/345 |

* cited by examiner

METHOD OF DRILLING AN INVESTIGATION WELL BY USE OF AUXILIARY TABLE OF A DUAL-ACTIVITY RIG SIMULTANEOUSLY WITH ANOTHER ACTIVITY ON MAIN TABLE

FIELD OF DISCLOSURE

The present disclosure pertains to the technical field of drilling oil and stratigraphic wells. Particularly, the present disclosure relates to a method of drilling an investigation well by using an auxiliary table, with simultaneous operation of a main table of a dual-activity rig.

BACKGROUND

The dual-activity type rig comprises two rotating tables—a main table and an auxiliary table, as well as redundancy of equipment, capable of allowing simultaneous operations. In this sense, the dual-activity rig aims at allowing concomitance of operations, reducing the non-productive time of the rig.

The present disclosure proposes the use of the auxiliary table of the dual-activity rig to drill an investigation well while carrying out other operations on the main table. In this way, geology data from shallow formations are acquired at no additional rig cost, since they are performed outside the critical path in relation to the main activities being carried out by the rig. In conventional drilling operations of these shallow formations, the profiles are not available, or the quality of data obtained is low due to the large drilling diameter.

Drilling a small diameter investigation well in shallow formations to acquire geological data using the auxiliary table of the dual-activity rig while carrying out other operations on the main table, translates into an improvement of the geological model, improvement in understanding shallow geological risks, and enabling safer and more optimized drilling operations.

Furthermore, with reference to the database already available for the region, availability of tools and purpose of acquisition, a geology team can select the profiles that will be acquired. Through this acquired data, correlations can be made possible for future operations, seeking to identify regions of high geomechanical risk, with breakouts, abnormally low densities, pressurized sands, among other events that represent risks to the drilling operation.

Accordingly, there are some methods for carrying out operations on the main table and auxiliary table, simultaneously, as indicated below.

Document PI 9715094-0 describes a method for carrying out multiple drilling activities simultaneously, from a single multi-activity drilling tower. In general, D1 provides a method for offshore exploration and/or field development drilling operations, utilizing a multi-activity drilling tower for primary, secondary and tertiary tubular activities simultaneously, removing certain operations from the critical path of the activity of primary drilling.

The document "Prova de conceito de um sistema para viabilizar a perfuração sem riser" (*Proof of concept of a system to enable drilling without riser*), by Roni A. Gandelman, Augusto B. Hougaz, Guilherme S. Vanni, Leonardo M. Ramalho and Emmanuel F. Nogueira, VI Encontro Nacional de Hidráulica de Poços de Petróleo e GÁs, 2015 is a document that discloses the use of a dual-activity rig in parallel activities, even after the installation of the BOP (Blowout Preventer) by the dual rig, significantly reducing the time and cost of well drilling. Specifically, it proposes drilling without a riser on the dual rig, in which a casing string is lowered at the same time as the wear bushing is removed.

None of the documents found discloses the use of a dual-activity rig to drill an investigation well in order to acquire geological data, in parallel with the operation of the main table, as proposed by the present disclosure.

SUMMARY OF THE DISCLOSURE

The present disclosure defines, according to a preferred embodiment thereof, a method of drilling an investigation well by using an auxiliary table, with operation of a main table of a dual-activity rig simultaneously, comprising the following steps: assembling and lowering the drilling BHA (Bottom-Hole Assembly) with LWD (Logging While Drilling) tools and other components, starting drilling the investigation well with control of parameters, carrying out monitoring with ROV (Remoted Operated Vehicle) on the seabed for as long as possible, working on drilling parameters to optimize drilling, within a defined rate for data acquisition, controlling flow rate in friable formations, moving viscous plugs to clean the investigation well, carrying out the pre-tests when part of the scope of acquisition, promoting seawater circulation to clean the investigation well, and filling the investigation well with heavy fluid, abandoning the investigation well with cement, if necessary.

BRIEF DESCRIPTION OF DRAWINGS

In order to complement the present description and obtain a better understanding of the features of this disclosure, a set of figures is presented, in which in an exemplified, although not limiting, manner, its preferred embodiment is represented.

DETAILED DESCRIPTION

The method of drilling an investigation well by using an auxiliary table, with operation of a main table of a dual-activity rig simultaneously, according to a preferred embodiment of the present disclosure, is described in detail, based on the figures attached.

Figure 1:
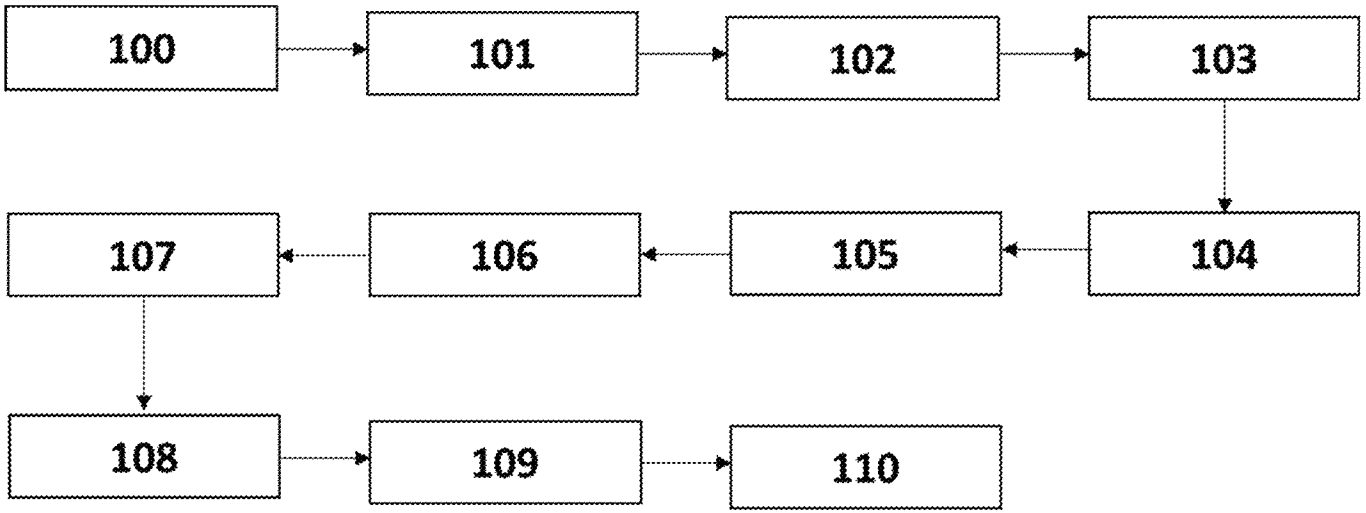
FIG. 1 illustrates a flowchart of the steps of the method of drilling an investigation well by using an auxiliary table, with operation of a main table of a dual-activity rig simultaneously, according to a preferred embodiment of the present disclosure.

FIG. 1 illustrates a flowchart of the steps of the method of drilling an investigation well by using an auxiliary table simultaneously with the operation of a main table of a dual-activity rig, according to a preferred embodiment of the present disclosure.

Specifically, the drilling method of the present disclosure comprises assembling and lowering the drilling BHA (Bottom-Hole Assembly) with LWD (Logging While Drilling) tools and other components, starting drilling the investigation well with control of parameters, carrying out monitoring with ROV (Remoted Operated Vehicle) on the seabed for as long as possible, working on drilling parameters to optimize drilling, within a defined rate for data acquisition (this rate depends on the requested profiles, but must vary between 15 and 45 m/h for data acquisition in memory, and with greater limitation for data transmission in real time), controlling flow rate in friable formations, moving viscous plugs to clean the investigation well, carrying out the pre-tests when part of the acquisition scope, promoting seawater circulation to clean the investigation well, and filling the investigation well with heavy fluid (heavy water-based drilling fluid—equivalent weight between 10.5 and 12.5 lb/gal (1.258 and 1.498 g/cm$^3$)), abandoning the investigation well with cement, if necessary.

The step of starting drilling the investigation well until completing the drilling of the first section of the investigation well 101 involves using a conventional fluid and a pre-determined flow rate.

Particularly, after the step of filling the investigation well 101 with heavy fluid 108, the method comprises the step of opening PBL (Plug-Back Depth) 109.

Furthermore, after the step of opening PBL (Plug-Back Depth) 109, the method comprises the step of executing abandonment plug 110 and removing drilling BHA (Bottom-Hole Assembly) 111.

Furthermore, during the step of removing drilling BHA (Bottom-Hole Assembly) (111), there are carried out, on the main table, the steps of assembling and lowering the BHA (202), cutting of cement and accessories, and changing of well fluid (203).

Figure 2:
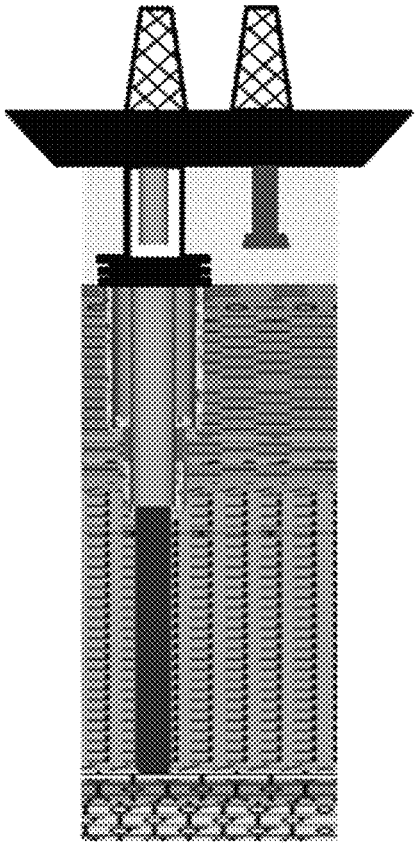
FIG. 2 presents an illustration showing the step of assembling and lowering the BHA, initiated during the lowering of the production casing and carried out on the main table.

As can be seen in the illustration in FIG. 2, in relation to the step of assembling and lowering the drilling BHA (Bottom-Hole Assembly) using RSS (Rotary Steerable System) in the example mentioned, although it is possible to use any other drilling system, LWD (Logging While Drilling), DJAR (Drilling Jar) and PBL (Plug-Back Depth) 100, this is initiated during the lowering of the production casing carried out on the main table 200.

Alternatively, the step of assembling and lowering the drilling BHA (Bottom-Hole Assembly) using RSS (Rotary Steerable System), LWD (Logging While Drilling), DJAR (Drilling Jar), and PBL (Plug-Back Depth) 100 is initiated during the completion intervention performed on the main table 200.

Furthermore, this can be done during the lowering of the intermediate casing, for example, or in any time window in which the auxiliary table is not being used.

Figure 3:
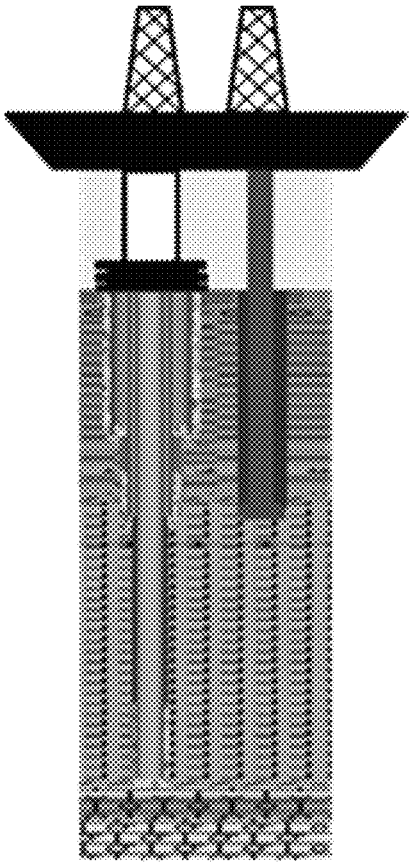
FIG. 3 represents an illustration identifying that, after the step of filling the investigation well with heavy fluid, the lowering of the production casing and the cementing of the casing are concluded, both occurring on the main table.

More specifically, as can be seen in the illustration in FIG. 3, after the step of filling the investigation well with heavy fluid 108, the lowering of the production casing and the cementing of the casing 201 are concluded, both carried out in the main table.

Figure 4:
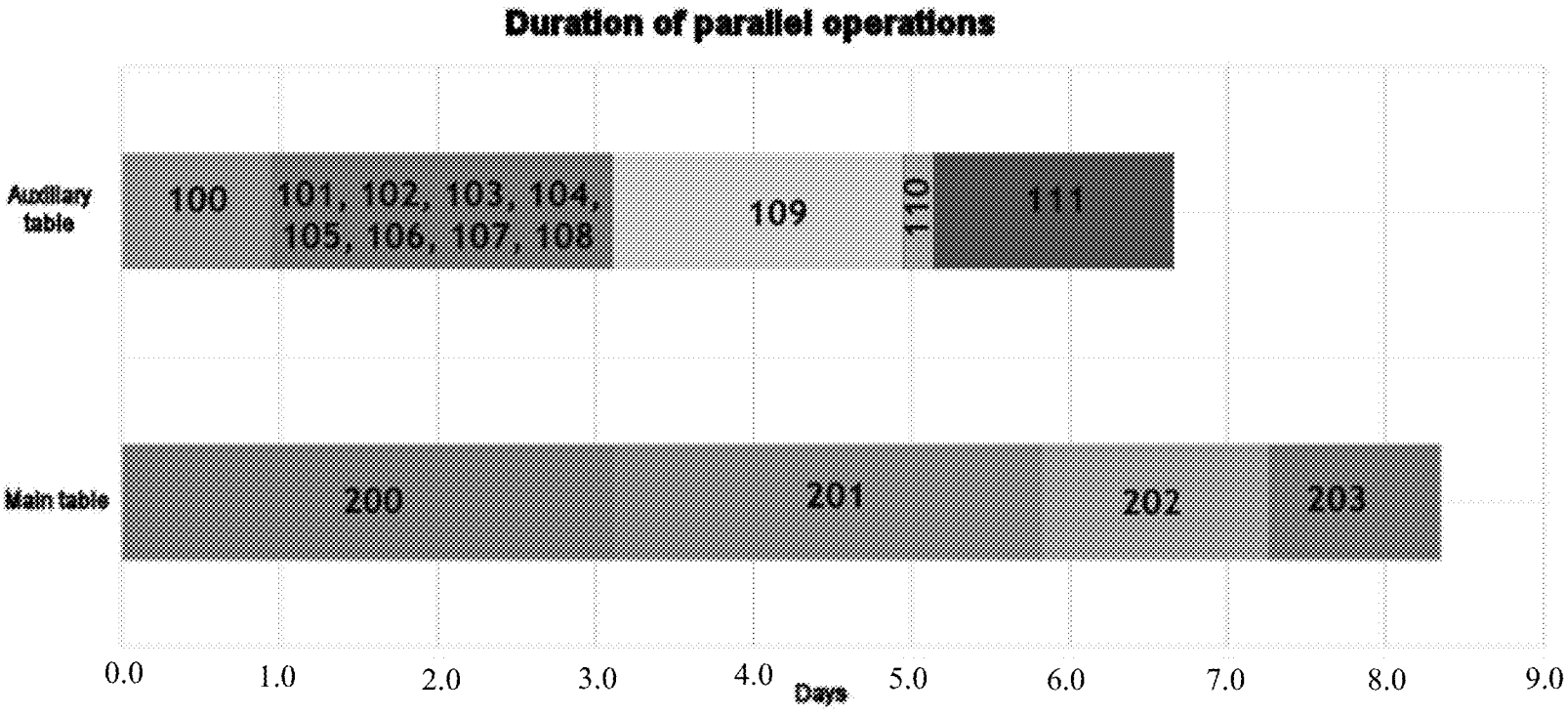
FIG. 4 represents a graph with an illustrative example of the method of drilling an investigation well by using an auxiliary table simultaneously with the operation of a main table of a dual-activity rig.

FIG. 4 represents a graph with an illustrative example of the method of drilling an investigation well by using an auxiliary table, simultaneously, with the operation of a main table of a dual-activity rig, and highlighting the parallelism between the operations on the main table and auxiliary table, as described in detail in the respective description in FIG. 1.

Regarding the definition of the operational window on the main table, this must be chosen to allow the following operations on the auxiliary table: assembling and lowering of the BHA, drilling of the investigation well, execution of the abandonment plug, and removal of the BHA.

Furthermore, the planning of the operational window on the main table and on the auxiliary table is carried out to adjust to any complications that may occur during the removal of the BHA carried out on the auxiliary table.

Complementarily, the planning of the operational window on the main table and on the auxiliary table must consider the availability of dual-activity rig resources (equipment and human resources, for example) for both interventions, on the main table and on the auxiliary table, without make safety and environmental aspects precarious.

The same way, the movement of pipes from concomitant operations must be evaluated to avoid interference between the main and auxiliary tables, as well as cargo reception and possible cargo transfers on the dual-activity rig deck.

Specifically in the pre-salt, two priority operational windows during the construction of the investigation well are recommended: the first operational window during drilling, in the assembly, lowering and cementing of the production casing, assembly of the BHA for reservoir drilling, and cutting the cement. The second operational window, during completion, in the lowering of the lower tail of the completion of the Open Well with Intelligent Completion (OWIC), and when the Production String (PS)/Injection String (IS) is lowered in a double run.

Another aspect that must be considered to determine the operational window is the meteorological condition. During drilling of the investigation well, the rig must maintain a fixed heading. Therefore, if there is a change in the meteorological conditions that generates the need to adjust the heading, the drilling must be stopped as far in advance as possible to carry out the abandonment plug, if necessary, and to remove the BHA from the investigation well.

In another aspect, when the BOP (Blowout Preventer) is disconnected in the main well to install the PAB (Production Adapter Base), this must be considered on the main table, not only due to the disconnection time, but also due to the negative tests of safety barriers (casing and universal seal assembly) and BOP tests, if provided for.

If the PAB is installed by the dual-activity rig itself, there must be provided, when planning the auxiliary table, additional time for preparations for the lowering of the PAB.

Regarding the collision between wells, the initial distance of the investigation well from the main well will be determined by the distance between the main and auxiliary rotating tables on the dual-activity rig platform. Anti-collision analysis in well planning must be carried out by considering the vertical investigation well and the actual trajectory of the main well. If the main well has deviated from the vertical during drilling, the heading of the rig towards the spud in of the investigation well must be provided for, preferably, at the preferential azimuth of 180° regarding the distance from the trajectory of the main well.

During the drilling of the main well, the more precise mapping of the well trajectory can be planned using a gyroscopic (Gyro) tool, to reduce the uncertainty ellipse. This mapping can be carried out either by launching a Drop Gyro tool (more economical alternative) or by using a Gyro While Drilling (GWD) tool. The ellipse of uncertainty in a trajectory measured with Gyro is on the order of 5 times smaller in area than the ellipse calculated with MWD (Measurement While Drilling) data.

As a recommended good practice, it may be proposed to perform an offset of the dual-activity rig before the drilling of the investigation well begins, thus increasing the initial distance between the main and investigation wells. After the drilling of the initial meters, the dual-activity rig can return to position over the main well.

During the drilling of the investigation well, with each survey received, it is necessary to redo the anti-collision analysis between the wells. The use of an active compensator in drilling must be provided for to minimize survey errors due to the axial fluctuation of the BHA. It is recommended to use a Rotary Steerable System (RSS) in the BHA to make possible trajectory corrections, aiming at maintaining the distance between wells within the parameters established by the Directional Drilling team. If the criteria established for the separation factor are exceeded, the drilling must be stopped and the end of the intervention planned.

For the composition of the BHA for drilling the investigation well, it is also recommended to use a Gyro While Drilling (GWD) tool for greater accuracy of the well trajectory and installation of a PBL valve.

Regarding the preparation for spud in, after defining the distance between the wells at the time of spud in of the investigation well, the location must be marked using buoys launched by the ROV. In this sense, it is recommended to use 2 buoys, approximately 4 m apart, positioned perpendicular to the azimuth of the investigation well.

The lowering of the drilling BHA must be initiated by reviewing the forecast meteorological conditions for the entire duration of the operation. Furthermore, it is necessary to register with the ROV the relative position of the BHA with the location demarcation buoys.

Additionally, the best direction for heading the rig must be assessed, based on wind and wave conditions on the surface, for the drilling window of the investigation well. If possible, the investigation well should be positioned in a quadrant opposite the predominant azimuth of the main well trajectory.

With reference to the drilling of the investigation well, if abnormal operational parameters are recorded, it is necessary to remove the bit from the bottom of the well, wait for normalization and resume drilling. If the abnormality persists, the decision to maintain or stop drilling should be discussed.

Furthermore, if vibrations above the specification of the LWD tools are recorded, operational parameters that mitigate the vibrations must be sought, in order to avoid failures in the electronic sensors. If the presence of vibrations persists, the drilling must be stopped and the continuation or completion of the intervention must be discussed.

In the case of the BHA comprising RSS (Rotary Steerable System) and in the event of the well trajectories approaching, it is necessary to direct the well in order to maximize the separation factor. In this sense, it is important to pay attention to a possible enlargement of the well in more friable formations, causing inefficiency or difficulty in orientation, and pump and dump pumping may be previously started, in order to improve the condition of the well.

As one of the advantages of the present disclosure, it is expected that the improvement of the geological model of the shallow formations will lead to a reduction in lost times with geomechanical occurrences, in addition to improving the selection of drilling bits, and choosing more suitable drilling fluids for the formations. In other words, the benefits are represented by the reduction in time and cost spent in constructing the well, as well as the optimization of the drilling of the surface phases.

Regarding the preliminary risk analysis, this task must be carried out with everyone involved in the operation and those contracted in the execution of the investigation well. An initial list of some risks for the intervention could be considered as: string stuck due to geomechanical instabilities in the shale and sandstone intercalations or during/after pumping of the cement plug; the PBL valve does not open due to seat washing or mechanical failure; impossibility of changing the heading of the rig during the operation period due to two intervention points on the seabed; collision between the investigation well and the main well due to the proximity between the trajectories and the uncertainty ellipse errors of the MWD equipment; proximity collision between the drill string and the BOP due to high drift; not being able to re-enter the investigation well in case of the need to change the BHA due to tool failure or loss of drill performance.

As a practical and exemplary application of the present disclosure, a history of influx occurrences in post-salt formations is shown in Table 1, where an average of lost time of 3 lost days is observed, in 4 wells (hereinafter referred to as A, B, C and D), to extinguish a problem and return to normal operations.

TABLE 1

History of post-salt inflows indicating average lost time to solve a problem and return to the normal operations

| Well Reference | Phase | Average lost time |
|---|---|---|
| A | 1 | 3 days |
| B | 1 | 3 days |
| C | 1 | 5 days |
| D | 2 | 1 day |

Those skilled in the art will value the knowledge presented herein and will be able to reproduce the disclosure in the presented embodiments and in other variants, encompassed by the scope of the attached claims.

The invention claimed is:

1. A method of drilling an investigation well by use of an auxiliary table and a main table of a dual-activity rig, the method comprising:

assembling and lowering a drilling bottom-hole assembly (BHA);

starting drilling of the investigation well with control of parameters to avoid enlargement in a seabed;

maintaining remote operated vehicle (ROV) at a bottom of the investigation well;

optimizing drilling parameters of the investigation well;

drilling the investigation well at a pre-defined drilling rate between 15 and 45 m/h, thereby to guarantee data acquisition through a plurality of profiles;

reducing the flow rate in friable formations to minimize well enlargement, thereby to carry out pre-tests;

moving viscous plugs to clean the investigation well;

performing pressure measurements in permo-porous formations with a pre-test tool and with a drill bit supported at the bottom of the investigation well;

circulating seawater to clean the investigation well; and filling the investigation well with heavy water-based drilling fluid to stabilize well walls, the drilling fluid having equivalent weight between 10.5 and 12.5 lb/gal (1.258 and 1.498 g/cm$^3$).

2. The method according to claim 1, wherein the step of starting drilling of the investigation well comprises using a clayey water-based drilling fluid and a predetermined flow rate.

3. The method according to claim 2, wherein the predetermined flow rate comprises a minimum flow rate used to maintain connection of the profiling tools, and wherein the minimum flow rate depends on a selected profile of the plurality of profiles.

4. The method according to claim 1, further comprising the step of removing drilling of the BHA, and wherein during the step of removing drilling of the BHA, there is carried out on the main table the steps of assembling and lowering the BHA, cutting of cement and accessories, and changing well fluid.

5. The method according to claim 4, wherein the step of assembling and lowering the drilling BHA comprises using rotary steerable system (RSS), logging while drilling (LWD), drilling jar (DJAR), and plug-back depth (PBL) operations started in parallel to another operation taking place on the main table.

6. The method according to claim 4, wherein the step of assembling and lowering the drilling BHA comprises using RSS, LWD, DJAR, and PBL operations initiated during completion intervention performed on the main table, or during a well maintenance operation.

7. The method according to claim 4, wherein the step of assembling and lowering the drilling BHA comprises using RSS, LWD, DJAR, and PBL operations during the lowering of intermediate casing, or in any time window in which an auxiliary table is not being used.

8. The method according to claim 1, wherein after the step of filling the investigation well with heavy fluid, lowering of production casing and cementing of the production casing are concluded, and wherein both of the lowering and the cementing are carried out on the main table.

9. A method of drilling an investigation well by simultaneous use of an auxiliary table and a main table of a dual-activity rig, the method comprising:

during an operational window on the main table, performing the following operations on the auxiliary table:

assembling and lowering a drilling bottom-hole assembly (BHA), starting drilling of the investigation well with control of parameters to avoid enlargement in a seabed, maintaining remote operated vehicle (ROV) at a bottom of the investigation well;

optimizing drilling parameters of the investigation well, drilling the investigation well at a pre-defined drilling rate between 15 and 45 m/h, thereby to guarantee data acquisition through profiles, reducing the flow rate in friable formations to minimize well enlargement, thereby to carry out pre-tests, moving viscous plugs to clean the investigation well, performing pressure measurements in permo-porous formations with a pre-test tool and with a drill bit supported at the bottom of the investigation well, circulating seawater to clean the investigation well, and filling the investigation well with heavy water-based drilling fluid to stabilize well walls, the drilling fluid having equivalent weight between 10.5 and 12.5 lb/gal (1.258 and 1.498 g/cm$^3$);

removing drilling of the BHA so that during the removing of the drilling, there is carried out on the main table assembling and lowering the BHA, cutting of cement and accessories, and changing well fluid; and lowering of production casing and cementing of the production casing are concluded so that both of the lowering and the cementing are carried out on the main table.

10. The method according to claim 9, wherein the step of assembling and lowering the drilling BHA comprises using rotary steerable system (RSS), logging while drilling (LWD), drilling jar (DJAR), and plug-back depth (PBL) operations started in parallel to another operation taking place on the main table.

11. The method according to claim 9, wherein the step of assembling and lowering the drilling BHA comprises using RSS, LWD, DJAR, and PBL operations initiated during completion intervention performed on the main table, or during a well maintenance operation.

12. The method according to claim 4, wherein the step of assembling and lowering the drilling BHA comprises using RSS, LWD, DJAR, and PBL operations during the lowering of intermediate casing, or in any time window in which an auxiliary table is not being used.

* * * * *